United States Patent [19]

Schumacher

[11] Patent Number: 4,730,869

[45] Date of Patent: Mar. 15, 1988

[54] WHEELCHAIR ARMREST STORAGE COMPARTMENT

[76] Inventor: Larry L. Schumacher, 18876 Tenderfoot Trail, Newhall, Calif. 91321

[21] Appl. No.: 896,836

[22] Filed: Aug. 15, 1986

[51] Int. Cl.[4] ..... A47C 7/62

[52] U.S. Cl. ..... 297/194; 280/289 WC; 297/DIG. 4

[58] Field of Search ..... 280/289 WC, 289 A; 297/194, 422, DIG. 4; 248/118, 118.1

[56] References Cited

U.S. PATENT DOCUMENTS

| | | | |
|---|---|---|---|
| 1,550,055 | 8/1925 | Augustine | 297/194 X |
| 3,042,467 | 7/1962 | Germick | 297/194 X |
| 4,339,061 | 7/1982 | Dunn | 297/194 |

*Primary Examiner*—John A. Pekar

[57] ABSTRACT

A storage compartment with a hinged cover which acts as an armrest is fixedly attached to the frame of a wheelchair and does not interfere with wheelchair folding, armrest frame removal, or occupant operation of propulsion rings and brakes. The storage compartments store small articles, identification, and money.

14 Claims, 7 Drawing Figures

WHEELCHAIR ARMREST STORAGE COMPARTMENT

BACKGROUND OF THE INVENTION

This invention relates to a compartment for carrying articles that is fixedly attached to a wheelchair frame and acts as an armrest.

Prior art discloses add on wheelchair attachments for carrying a large number of small articles and a few book sized articles.

It is the general object of this invention to provide wheelchair occupants easily accessible, safe, unobtrusive storage for small personal articles, identification and money.

Another object is to provide a wheelchair storage compartment which does not interfere with necessary wheelchair functions such as:

- movement of the wheelchair with the propulsion rings,
- folding the wheelchair for storage or transport,
- removal of the armrest frame for occupant transfers,
- operation of brakes, belt tensioners, foot rests, and other wheelchair accessories.

These and other objectives will be made apparent in the following description and claims.

SUMMARY OF THE INVENTION

The present invention is a storage compartment for small personal articles that is fixedly attached to a wheelchair armrest frame. The closed compartment cover acts as the wheelchair armrest. The cover is hinged with flexible fabric so that when the cover is open it hangs outside of the wheelchair occupant's space between the armrest frames. The article storage compartment above the armrest frame is shallow to minimize armrest height and one embodiment has a deep storage compartment external to the occupant space parallel to the wheelchair armrest frame. The deep storage compartments have removable liners to facilitate article storage and retrieval.

DESCRIPTION OF THE INVENTION

Figure 1:
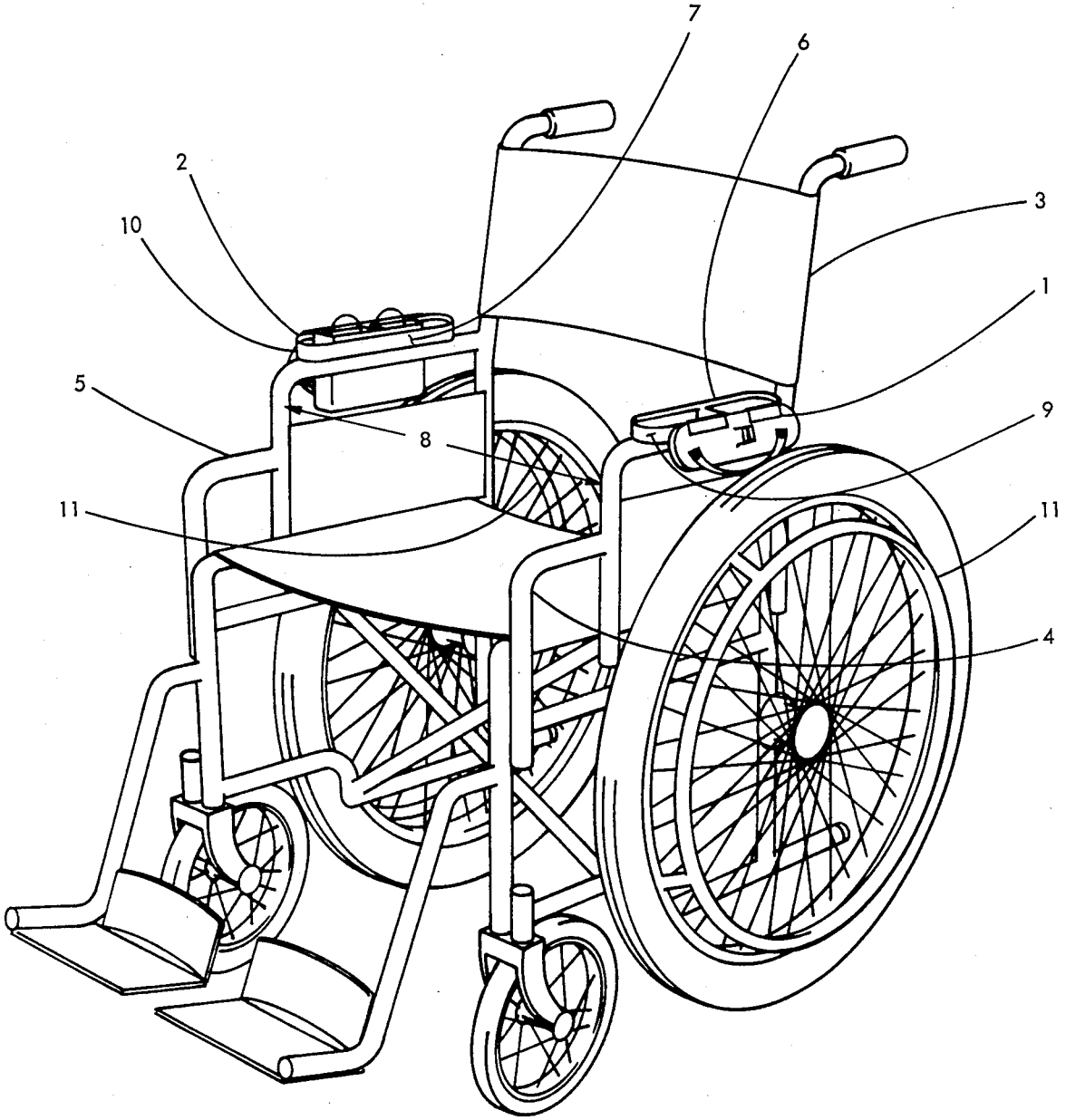
FIG. 1 is a perspective view of two wheelchair armrest storage compartments installed in the preferred orientation on a wheelchair.

FIG. 1 illustrates two embodiments of wheelchair armrest storage compartments 1 and 2 mounted on a wheelchair 3 and fixedly attached to wheelchair armrest frames 4 and 5. The preferred installation has compartment walls 6, 7 not occupying any occupant space 8 between armrest frames 4 and 5.

The substantially vertical outboard compartment surfaces 9, 10 are intended to not interfere with occupant operation of wheel propulsion rings 11.

Figure 2:
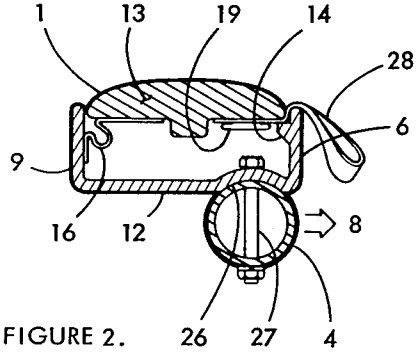
FIG. 2 is a front section view of the preferred embodiment of the armrest storage compartment with the cover closed.

FIG. 2 illustrates a cutaway section of storage compartment 1 with the cover 13 in the horizontal closed position with all exterior surfaces of 13 and corners 20,21 rounded. Closed cover 13 is supported on its bottom periphery by ridge 14 on the interior of compartment substantially vertical outer walls 6 and acts as wheelchair occupant armrest. Cover 13, exterior walls 6,9, interior wall 12, and bottom 22 are substantially rigid material.

Cover 13 is hinged to storage compartment wall 9 by a flexible fabric 16. Fabric 16 is attached to wall 9 and cover 13 and is long enough between attachments 9, 13 to permit fully open cover 13 to hang approximately parallel to the approximately vertical compartment wall 9. Excess hinge fabric 16 is folded within the interior of storage compartment 1 when the cover 13 is closed.

Storage compartment 1 is attached by threaded means 27 to the wheelchair armrest frame 4 in depression 26 in the substantially horizontal bottom 22 of storage compartment 1 parallel to the compartment wall 6 adjacent to occupant space 8. Threaded means 27 maintains compartment 1 as vertical armrest load bearing member between wheelchair occupant and armrest frame 4.

The cover 13 is opened with a length of ribbonlike material 28 removably attached to the cover 13 by buttonlike attachments 19. The ribbonlike material 28 passes between the cover 13 and compartment vertical wall 6 to the exterior of the compartment near the wheelchair occupant who can open the cover by pulling upward on the ribbon.

Figure 3:
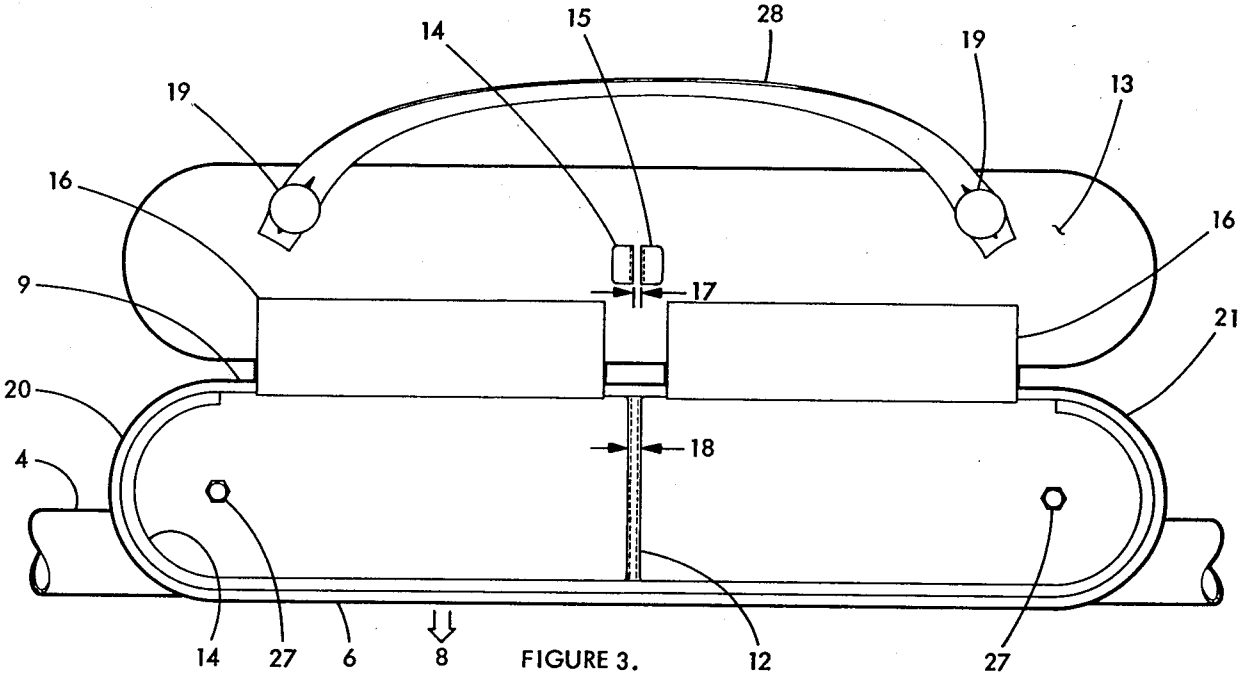
FIG. 3 is a side section view of the preferred embodiment of the storage compartment with the cover closed.
Figure 4:
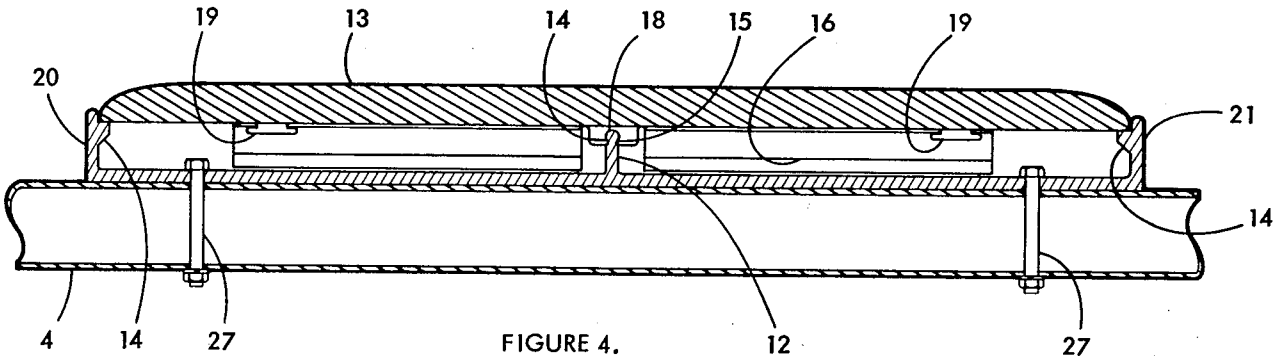
FIG. 4 is a top view of the preferred embodiment of the storage compartment with the cover partially open.

FIGS. 3 and 4 illustrate internal compartment wall 12 which assists in support of the closed compartment cover 13 releasably. The cover 13 is held closed by grasping internal wall 12 with latch elements 14, 15 attached to inside surface of cover 13.

The entrance opening distance 17 between latch elements 14, 15 is less than the width of the round bead 18 on the top of wall 12 so that force is required to open or close cover 13 by forcing latch elements 14, 15 over bead 18. Storage compartment end walls 20, 21 have rounded corners and cover 13 support ridge 14.

Figure 5:
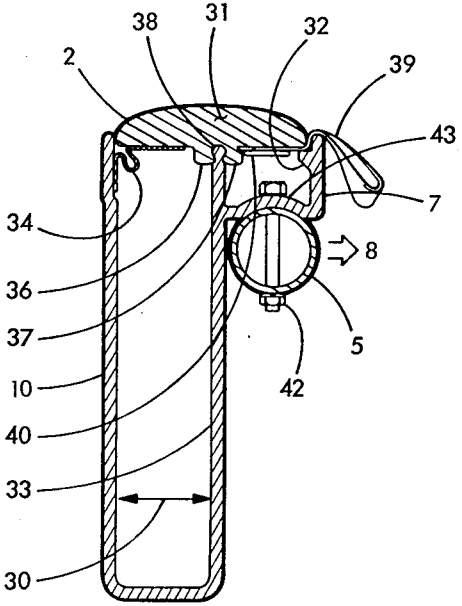
FIG. 5 is a front section view of a second embodiment of the armrest storage compartment with deep storage compartment liners removed for clarity.

FIG. 5 illustrates a front cutaway section of an alternate storage compartment 2 with deep storage compartment 30 parallel to the armrest frame 5 outside of the occupant space 8. The compartment cover 31 is supported on its periphery by ridge 32 and deep storage compartment wall 33. The cover 31 is hinged by flexible fabric 34 to compartment wall 10. Latch elements 36, 37 hold the cover 31 closed when forced over the round bead 38 on the top of deep storage wall 33. Ribbonlike material 39 is removably attached to cover 31 at 40. The ribbon 39 passes between closed cover 31 and compartment wall 7 and is used to open cover 31. Compartment 2 rests on frame 5 in depression 43 and is attached to armrest frame 5 by threaded means 42.

Figure 6:
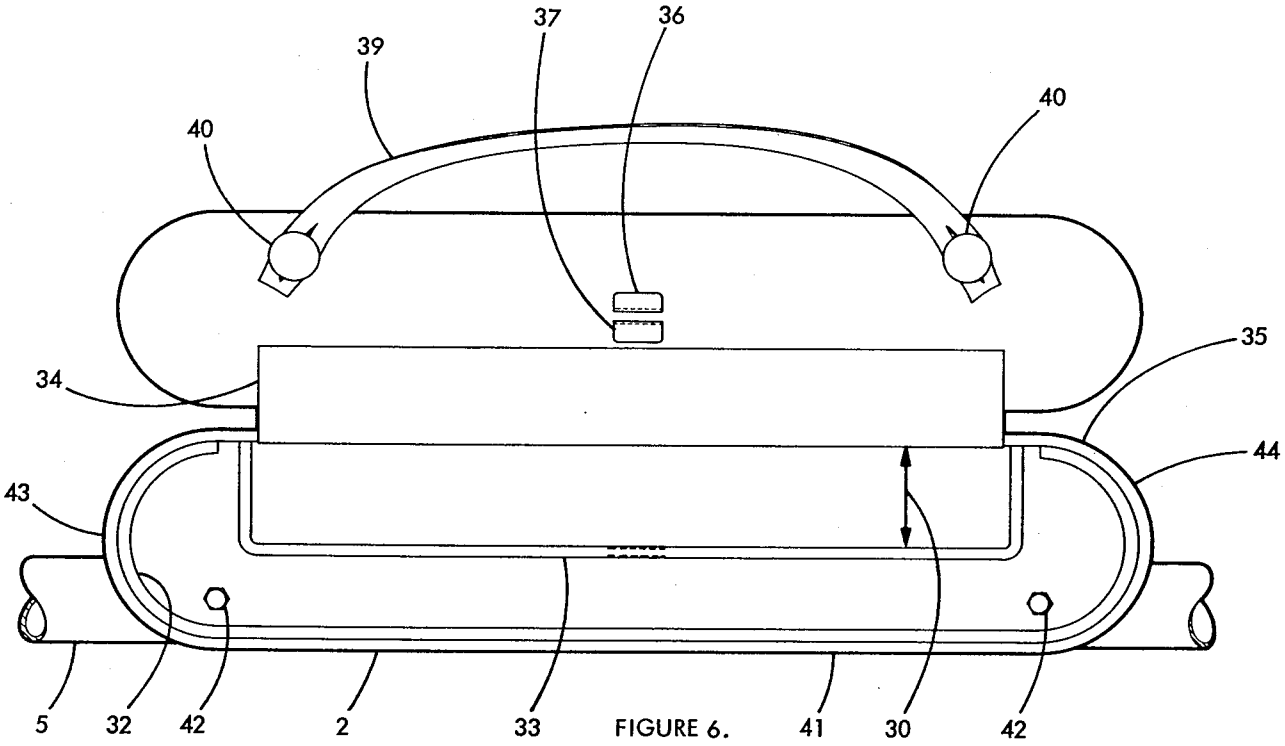
FIG. 6 is a top view of the second embodiment of the armrest storage compartment with the cover partially open and deep storage compartment liners removed for clarity.

FIG. 6 is a top view of storage compartment 2 with cover partially open which illustrates placement of the deep storage 30 relative to armrest frame 5. The storage compartment 2 configuration above armrest frame 5 has rounded corners 43 and 44 and cover 31 support ridge 32.

Figure 7:
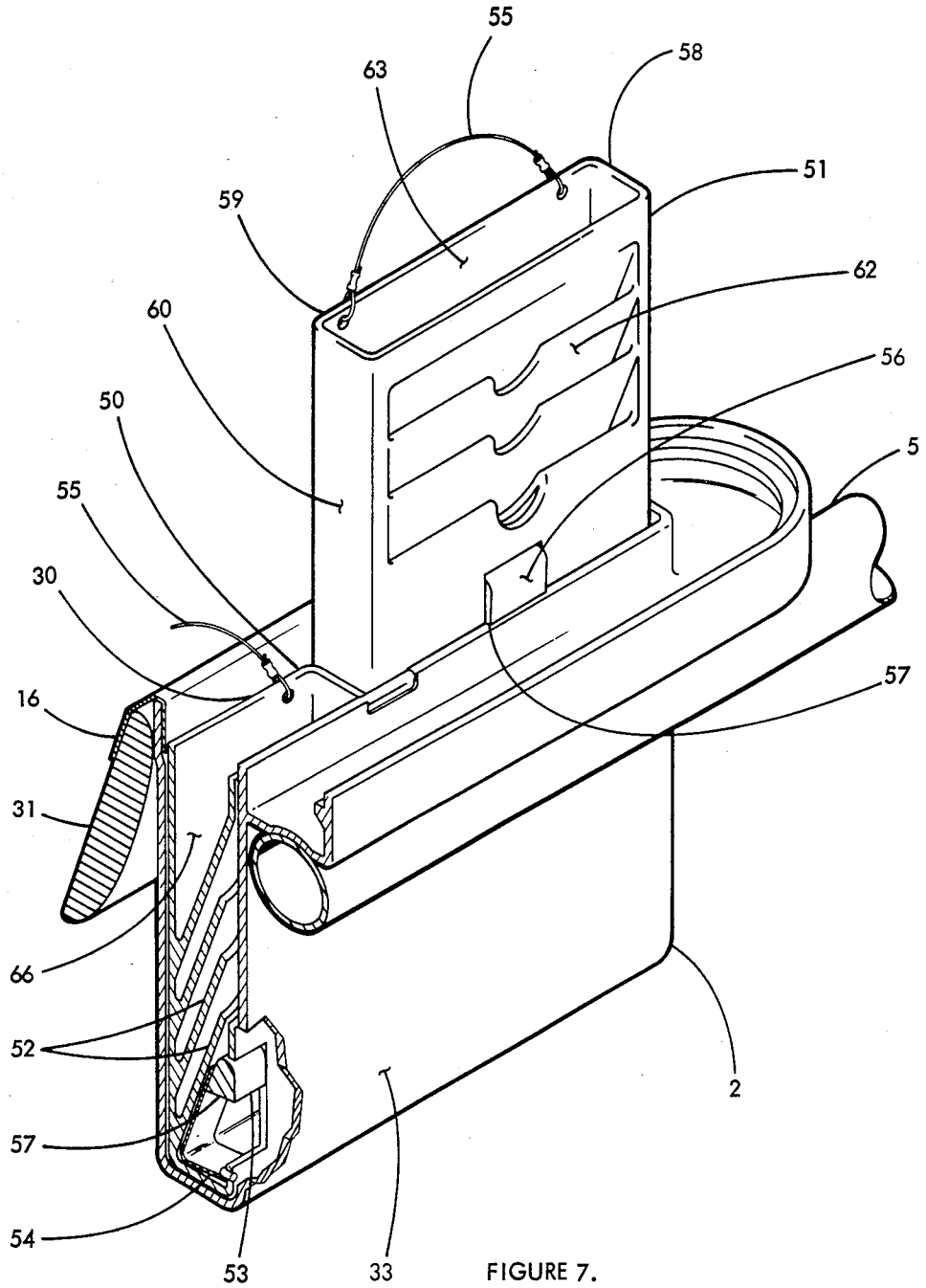
FIG. 7 is an isometric view of the second embodiment of the armrest storage compartment with deep storage compartment liners included and the cover fully open.

FIG. 7 is a cutaway perspective view of storage compartment 2 with cover 31 fully open illustrating deep storage compartment 30 removable liners 50, 51. Liner 50 storage volume 66 is separated by inclined shelves 52, and is slidably confined within storage compartment 30 substantially vertical walls 10, 33. Liner latch spring 54 forces liner latch 53 against compartment wall 33. When liner 51 is raised sufficiently by wheelchair occupant using flexible attachment 55, spring loaded liner latch 56 engages the compartment wall 33 on latch edge 57 and holds the liner 51 in a raised position. To lower liner 51 the wheelchair occupant forces liner latch 56 off of latch edge 57 and liner 51 slides back into compartment 30.

Liner 51 storage volume is contained within liner vertical walls 58, 59, 60 and is accessible from open liner side 62 and open top 63.

Having described the invention, I claim:

1. Storage compartments acting as a wheelchair armrest comprising:

at least one storage compartment of substantially rigid material extending substantially above the top of a wheelchair armrest frame;

at least one deep storage compartment of substantially rigid material extending substantially below the top of a wheelchair armrest frame;

a cover for said storage compartments;

means on said storage compartments to support said compartment cover in a closed position;

a compartment cover hinge means;

means to hold said compartment cover closed;

means to open said compartment cover;

means to mount one of said storage compartments to a wheelchair armrest frame.

2. The wheelchair armrest storage compartments according to claim 1 wherein the storage compartment cover comprises substantially rigid material having all exterior surfaces and corners rounded and being supported from below around the cover bottom periphery by a ridge on the interior surface of exterior vertical walls of said compartments with said cover being recessed below the top of the vertical compartment walls and having a cover upper surface periphery slightly above the level with the top of said supporting compartment walls.

3. The wheelchair armrest storage compartments according to claim 1 wherein the storage compartment substantially above wheelchair armrest frame comprise a substantially rigid horizontal bottom being attached to the wheelchair armrest frame and substantially rigid veritcal walls supporting said compartment cover, said horizontal bottom being ridgidly attached to said vertical walls with storage volume contained within said horizontal and vertical walls being accessible from said open compartment cover.

4. The wheelchair armrest storage compartments according to claim 1 wherein the means to support said compartment cover comprises a ridge attached on the interior of vertical exterior compartment walls and the top of vertical internal compartment walls with the vertical exterior walls extending above the cover support ridge around the cover periphery.

5. The wheelchair armrest storage compartments according to claim 1 wherein the means to hold said compartment cover closed comprises a latch element on said cover which releasably engages an interior wall between said compartments.

6. The wheelchair armrest storage compartments according to claim 1 wherein the compartment cover hinging means comprises a flexible fabric being attached to an interior surface of said compartment cover and being attached to interior surface of a vertical wall of said storage compartments.

7. The wheelchair armrest storage compartments according to claim 6 wherein said compartment cover hinging means further comprises hinge fabric long enough between attachments to permit said compartment cover to hang outside and approximately parallel to a substantially vertical exterior compartment wall when fully open, said hinge fabric being folded within said storage compartment with said compartment cover closed.

8. The wheelchair armrest storage compartments according to claim 1 wherein said storage compartment mounting means comprises threaded means attaching said storage compartment bottom to the top of wheelchair armrest frame and maintaining said storage compartment in the vertical load bearing path between armrest forces and said wheelchair armrest frame.

9. The wheelchair armrest storage compartments according to claim 1 wherein the means to open said compartment cover comprises flat ribbonlike material attached to the interior compartment cover surface, said ribbonlike material passing between said storage compartment vertical wall and said closed compartment cover and being used by the wheelchair occupant to apply vertical opening forces to said closed compartment cover.

10. The wheelchair armrest storage compartments according to claim 1 wherein said at least one deep storage compartment comprises substantially vertical substantially rigid walls rigidly attached to a substantially horizontal substantially rigid bottom forming storage volumes with compartment liners, said deep storage compartment being adjacent to said wheelchair armrest frame outside the occupant space and being rigidly attached to said storage compartment above wheelchair armrest frame with both compartments being accessible from the same open compartment cover.

11. The wheelchair armrest storage compartments according to claim 10 wherein the compartment liners comprise:

means to store items;

means to raise liners vertically relative to deep storage compartment walls;

means to releasably hold liners in a raised position.

12. The wheelchair armrest storage compartments according to claim 11 wherein the means to store items comprises a storage volume with three vertical liner sides separated by shelves, said storage volumes being accessible from the open liner side and open liner top and being slideably confined within substantially vertical deep storage compartment walls.

13. The wheelchair armrest storage compartments according to claim 11 wherein the means to raise said compartment liners comprises a flexible cord attached to the top of said liner forming a loop accessible from an open compartment cover to the wheelchair occupant for raising said liner vertically in the deep storage compartment.

14. The wheelchair armrest storage compartments according to claim 11 wherein the means to releasably hold liners in a raised position in said deep storage compartment comprises a latch structure with a substantially horizontal liner latch edge being housed within the liner volume while being forced by a spring mechanism outward through an opening in the vertical liner side to be in forcible contact with said storage compartment vertical wall with the horizontal liner latch edge engaging the top of said deep storage compartment vertical wall holding said removeable liner in a raised position.

* * * * *